US011749907B2

(12) United States Patent
Wang et al.

(10) Patent No.: US 11,749,907 B2
(45) Date of Patent: Sep. 5, 2023

(54) ANTENNA OF A TERMINAL DEVICE

(71) Applicant: VIVO MOBILE COMMUNICATION CO., LTD., Guangdong (CN)

(72) Inventors: Yijin Wang, Dongguan (CN); Huan-chu Huang, Dongguan (CN); Xianjing Jian, Dongguan (CN)

(73) Assignee: VIVO MOBILE COMMUNICATION CO., LTD., Dongguan (CN)

( * ) Notice: Subject to any disclaimer, the term of this patent is extended or adjusted under 35 U.S.C. 154(b) by 222 days.

(21) Appl. No.: 17/199,941

(22) Filed: Mar. 12, 2021

(65) Prior Publication Data

US 2021/0203083 A1 Jul. 1, 2021

Related U.S. Application Data

(63) Continuation of application No. PCT/CN2019/101703, filed on Aug. 21, 2019.

(30) Foreign Application Priority Data

Sep. 14, 2018 (CN) ..... 201811076748.4

(51) Int. Cl.
*H01Q 21/08* (2006.01)
*H01Q 1/48* (2006.01)
(Continued)

(52) U.S. Cl.
CPC ..... *H01Q 21/08* (2013.01); *H01Q 1/48* (2013.01); *H01Q 13/10* (2013.01); *H01Q 21/0006* (2013.01)

(58) Field of Classification Search
CPC .... H01Q 1/22–48; H01Q 1/243; H01Q 1/273; H01Q 13/10; H01Q 21/00; H01Q 21/06–08
See application file for complete search history.

(56) References Cited

U.S. PATENT DOCUMENTS 2,977,595 A 3/1961 Zisler et al.
6,184,828 B1 2/2001 Shoki
(Continued)

FOREIGN PATENT DOCUMENTS

CN 101572337 A 11/2009
CN 203481374 U 3/2014
(Continued)

OTHER PUBLICATIONS

International Search Report and Written Opinion of the International Searching Authority regarding International Patent Application No. PCT/CN2019/101703, dated Nov. 11, 2019. Translation provided by Bohui Intellectual Property.
(Continued)

*Primary Examiner* — Hasan Islam
(74) *Attorney, Agent, or Firm* — Harness, Dickey & Pierce, P.L.C.

(57) ABSTRACT

An antenna of a terminal device, the antenna includes a metal frame, a side of the metal frame is provided with at least two slots, and the slots are ring-shaped slots. Portions of the metal frame at two sides of each slot of the at least two slots are provided with two groups of feed points, and each group of feed points includes an antenna feed point located on a portion of the metal frame at the inner side of the slot, and a ground feed point located on another portion of the metal frame at the outer side of the slot. The metal frame is electrically connected to a floor in the terminal device.

10 Claims, 3 Drawing Sheets

(51) Int. Cl.
*H01Q 13/10* (2006.01)
*H01Q 21/00* (2006.01)

(56) References Cited

U.S. PATENT DOCUMENTS

| | | | | |
|---|---|---|---|---|
| 7,986,279 | B2 | 7/2011 | Bruno et al. | |
| 10,200,092 | B1 * | 2/2019 | Irci | H04B 7/0413 |
| 2009/0273418 | A1 | 11/2009 | Shimizu et al. | |
| 2010/0025480 | A1 | 2/2010 | Nishizawa et al. | |
| 2015/0349421 | A1 | 12/2015 | Sharawi | |
| 2016/0112551 | A1 * | 4/2016 | Hung | H01Q 1/243 455/575.7 |
| 2017/0302771 | A1 * | 10/2017 | Kim | H01Q 9/42 |
| 2019/0036210 | A1 * | 1/2019 | Kim | H01Q 13/10 |
| 2019/0181538 | A1 | 6/2019 | Xia et al. | |

FOREIGN PATENT DOCUMENTS

| | | | |
|---|---|---|---|
| CN | 205846232 | U | 12/2016 |
| CN | 106935962 | A | 7/2017 |
| CN | 206864616 | U | 1/2018 |
| CN | 108232470 | A | 6/2018 |
| CN | 108270080 | A | 7/2018 |
| CN | 108321487 | A | 7/2018 |
| CN | 207781866 | U | 8/2018 |
| CN | 109066079 | A | 12/2018 |
| CN | 109193134 | A | 1/2019 |
| JP | 2018050106 | A | 3/2018 |

OTHER PUBLICATIONS

First Office Action regarding Chinese Patent Application No. 201811076748.4, dated Nov. 26, 2019. Translation provided by Bohui Intellectual Property.

Second Office Action regarding Chinese Patent Application No. 201811076748.4, dated Jun. 3, 2020. Translation provided by Bohui Intellectual Property.

Notification to Grant Patent Right for Invention regarding Chinese Patent Application No. 201811076748.4, dated Sep. 4, 2020. Translation provided by Bohui Intellectual Property.

"MM-Wave Phased Array Antenna for Whole-Metal-Covered 5G Mobile Phone Applications," J. Bang, et al., Dec. 21, 2017.

"Study on Large-Scale MIMO Antenna Array for 5G Mobile Network," Z. Changqing, 2016.

* cited by examiner

ANTENNA OF A TERMINAL DEVICE

CROSS REFERENCE TO RELATED APPLICATIONS

This application is a Bypass Continuation Application of PCT/CN2019/101703 filed on Aug. 21, 2019, which claims priority to Chinese Patent Application No. 201811076748.4, filed on Sep. 14, 2018, which are incorporated herein by reference in their entirety.

TECHNICAL FIELD

The present disclosure relates to the field of communications technologies, and in particular, to an antenna of a terminal device.

BACKGROUND

Multi-antenna communications has become the mainstream and a development trend of terminal devices in the future, and millimeter wave antennas are gradually introduced to terminal devices as the communications technologies evolve rapidly.

SUMMARY

Some embodiments of the present disclosure provide an antenna of a terminal device, including a metal frame, where a side of the metal frame is provided with at least two slots, and the slots are ring-shaped slots; portions of the metal frame at two sides of each slot of the at least two slots are provided with two groups of feed points, each group of feed points include an antenna feed point located on a portion of the metal frame at an inner side of the slot, and a ground feed point located on another portion of metal frame at an outer side of the slot; and the metal frame is electrically connected to a floor in a terminal device.

BRIEF DESCRIPTION OF DRAWINGS

To describe the technical solutions in some embodiments of the present disclosure more clearly, the following briefly describes the accompanying drawings required for describing some embodiments of the present disclosure. Apparently, the accompanying drawings in the following description show merely some embodiments of the present disclosure, and a person of ordinary skill in the art may still derive other drawings from these accompanying drawings.

DETAILED DESCRIPTION OF EMBODIMENTS

The following clearly and completely describes the technical solutions in some embodiments of the present disclosure with reference to the accompanying drawings in some embodiments of the present disclosure. Apparently, the described embodiments are merely some but not all of the embodiments of the present disclosure. All other embodiments obtained, on the basis of the embodiments in the present disclosure, by a person of ordinary skill in the art shall fall within the protection scope of the present disclosure.

In the related art, as the millimeter-wave antenna is generally in the form of an independent antenna module, it is required to provide space for accommodating the independent antenna module in a terminal device. In this case, the volume of the entire terminal device is relatively large, resulting in relatively low overall competitiveness of the terminal device.

Figure 1:
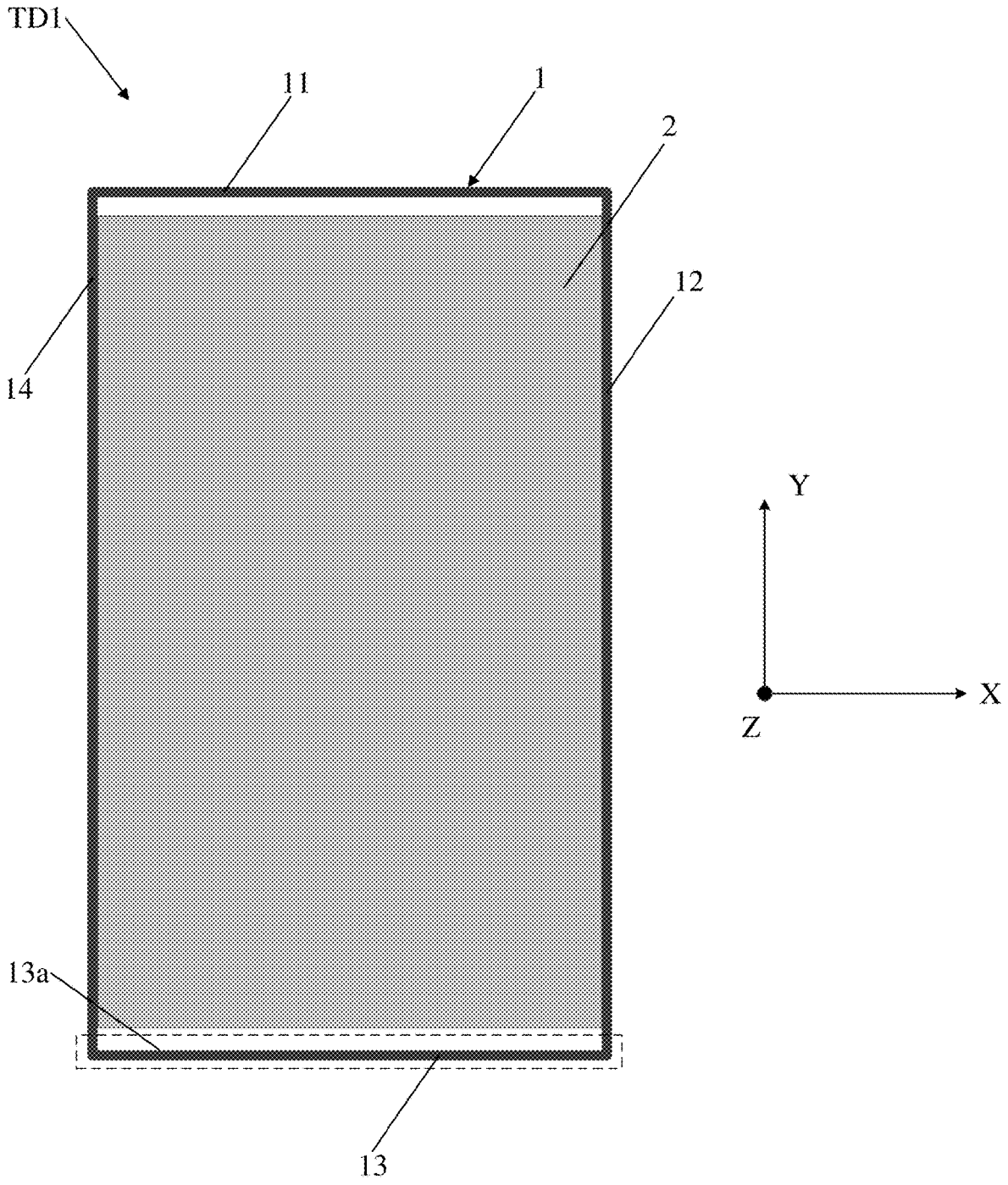
FIG. 1 is a schematic structural diagram of an antenna of a terminal device according to some embodiments of the present disclosure.

Referring to FIG. 1, FIG. 1 is a schematic structural diagram of a terminal device according to some embodiments of the present disclosure. As shown in FIG. 1, a terminal device TD1 includes an antenna of the terminal device, the antenna includes a metal frame 1 and at least two slots are disposed at a side of the metal frame 1, where the slots are ring-shaped slots; portions of the metal frame 1 at two sides of each slot of the at least two slots are provided with two groups of feed points, and each group of feed points include an antenna feed point located on a portion of the metal frame 1 at an inner side of the slot, and a ground feed point located on another portion of metal frame 1 at an outer side of the slot; and the metal frame 1 is electrically connected to a floor 2 in a terminal device.

In some embodiments, the foregoing metal frame 1 may include a first side 11, a second side 12, a third side 13, and a fourth side 14, and the metal frame 1 may be a frame of which ends are connected or disconnected. The inside of the foregoing slot may be air, or filled with a non-conductive material. The foregoing floor 2 may be a circuit board, a metal middle cover or the like. The foregoing metal frame 1 is electrically connected to the floor 2 within the terminal device, so that the metal frame 1 can be grounded.

In some embodiments, at least two slots are disposed at a side of the metal frame 1, where portions of the metal frame 1 at a side of each slot of the at least two slots is provided with two groups of feed points, and each group of feed points include an antenna feed point located on a portion of the metal frame 1 at the inner side of the slot, and a ground feed point located on another portion of the metal frame 1 at the outer side of the slot. A signal wire of a feed source of a millimeter wave signal is connected to the antenna feed point, and a ground wire of the feed source is connected to the ground feed point. In this way, the at least two slots are equivalent to forming a millimeter wave array antenna for radiating a millimeter wave signal. In the case that at least two slots are disposed on the third side 13, a communications antenna may be as shown by the dashed line in FIG. 1, and the communications antenna is composed of the third side 13, a part of the second side 12 and a part of the fourth side 14. Additionally, the millimeter wave array antenna composed of the at least two slots is a tiny slot in a radiating body of a non-millimeter wave communications antenna, so that electrical parameters of the non-millimeter wave communications antenna are not affected. It is sure that in addition to setting at least two slots on the third side 13, at least two slots may also be set on the first side 11, the second side 12 or the fourth side 14, which is not limited in this embodiment.

In this way, arranging at least two slots at a side of portions of the metal frame 1 of the terminal device is equivalent to forming a millimeter wave array antenna, thereby saving space for accommodating a millimeter wave array antenna, skipping occupying antenna space for another antennas, reducing a volume of the terminal device, and improving overall competitiveness of the terminal device. A structure of the terminal device can be fully used as an antenna to enhance a communications effect without affecting metal texture of the terminal device. In addition, it can be avoided that performance of the millimeter wave antenna dropping significantly when the back facet of the terminal device is blocked by a metal table or when a user holds the terminal device in hand, thus providing a better user experience.

Additionally, integrating a millimeter wave array antenna into a communications antenna in the related art, such as 2G, 3G, 4G or sub 6G, does not affect communications quality of a non-millimeter wave communications antenna. In addition, a metal frame design based on a terminal device of the present disclosure does not affect metal texture of the terminal device.

It is often difficult to make a current mainstream millimeter wave antenna design, such as an antenna-in-package (AiP) millimeter wave antenna module, to exhibit good antenna performance under a design with a metal appearance, that is, it is difficult to support the design with a metal appearance, thus reducing competitiveness of a product. Such a design pattern of this embodiment can support the design with a metal appearance in a better way, and can be compatible with a design with a metal appearance as a solution for another antenna, to enhance overall competitiveness of a product. It can resolve the problem that it is required to arrange space for accommodating a millimeter wave antenna in a terminal device, which requires a large volume of the whole terminal device, it can also resolve the problem that it is difficult for a terminal device to support a design with a metal appearance.

In some embodiments, the foregoing terminal device may be a mobile phone, a tablet personal computer (Tablet Personal Computer), a laptop computer (Laptop Computer), a personal digital assistant (personal digital assistant, PDA), a mobile Internet device (Mobile Internet Device, MID), a wearable device, or the like.

Alternatively, any group of feed points is located on an inner wall of the metal frame.

In some embodiments, any group of feed points is located on the inner wall (for example, a inner wall 13*a* is shown in FIG. 1) of the metal frame, which firstly can facilitate setting of an antenna feed point and a ground feed point in each group of feed points, and secondly will not affect an appearance of the terminal device.

Alternatively, the at least two slots are arranged along a length direction of the metal frame 1.

In some embodiments, the at least two slots are arranged along the length direction of the metal frame 1, which firstly can facilitate setting of multiple slots on the metal frame 1. Secondly, it is convenient for the at least two slots to form the millimeter wave array antenna, to radiate millimeter wave signals or receive millimeter wave signals.

Figure 2:
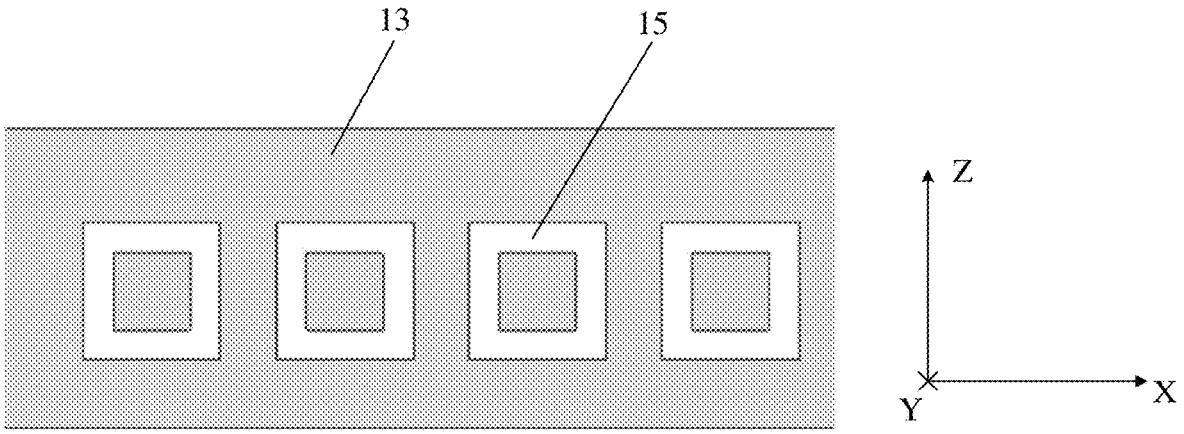
FIG. 2 is a first schematic structural diagram of a side of a metal frame according to some embodiments of the present disclosure.

Reference may be made to FIG. 2 to better understand the foregoing setting way, which is a schematic structural diagram of a side of a metal frame according to the present disclosure. As shown in FIG. 2, at least four slots 15 are provided on the third side 13 of the metal frame 1, the at least four slots 15 are arranged along the length direction of the third side 13 of the metal frame 1 to form a millimeter wave array antenna.

It is sure that a width of each slot of FIG. 2 may be unlimited. In the case that the inside of the slot is air, an outer circumference and an inner circumference of the slot may be unlimited. It is sure that as an alternative solution, the outer circumference of the slot may be 17.6 millimeter (mm), and the inner circumference of the slot may be 11 mm. In the case that the slot is filled with non-conductive medium, the outer circumference and the inner circumference of the slot may be adjusted according to an actual bandwidth, and cover an operating frequency band of a millimeter wave.

Alternatively, spacing between two adjacent slots is determined by isolation between the two adjacent slots and performance of a beam scanning coverage angle of an array antenna.

In some embodiments, spacing between the foregoing two adjacent slots is determined by isolation between the two adjacent slots and performance of the beam scanning coverage angle of the array antenna, with which the millimeter wave signal can work in a better way.

Alternatively, spacing between any two adjacent slots is the same.

In some embodiments, spacing between any two foregoing adjacent slots is the same, which can make an appearance more symmetrical, and ensure that the millimeter wave array antenna composed of at least two slots has better performance, with which the millimeter wave signal can work in a better way.

Alternatively, a shape of the slot is a rhombus, a circle or a regular polygon.

In some embodiments, a shape of the foregoing slot is the rhombus, the circle or the regular polygon, and the regular polygon may be a regular triangle, a square, a regular pentagon, a regular hexagon, or the like. Thus, the shape of the slot may be set according to an actual need, and different shapes may be set according to different actual situations and needs, so as to meet different needs and adapt to more different scenarios.

Alternatively, in two groups of feed points corresponding to each slot, a straight line determined by a group of feed points is perpendicular or not perpendicular to a straight line determined by another group of feed points.

In some embodiments, a straight line determined by a group of feed points is a straight line determined according to an antenna feed point and a ground feed point in the group. Similarly, a straight line determined by another group of feed points is also a straight line determined by an antenna feed point and a ground feed point in the group. In two groups of feed points corresponding to each slot, whether a straight line determined by a group of feed points is perpendicular to a straight line determined by another group of feed points may be set according to an actual need, which is not limited in this embodiment.

As an alternative manner, the straight line determined by a group of feed points may be perpendicular to the straight line determined by another group of feed points. As the straight line determined by a group of feed points is perpendicular to the straight line determined by another group of feed points, an orthogonal feeding mode is used for each slot with respect to electrical properties, so that a multiple input and multiple output (that is, MIMO) function can be generated to improve a data transmission rate on one hand, and wireless connection capability of a millimeter wave antenna array can be improved to reduce probability of communications disconnection and improve a communications effect and user experience on the other hand.

Alternatively, the shape of the slot is the square, different groups of feed points in two groups of feed points corresponding to each slot are respectively located on portions of the metal frame corresponding to midpoints of different sides of the slot.

Figure 3:
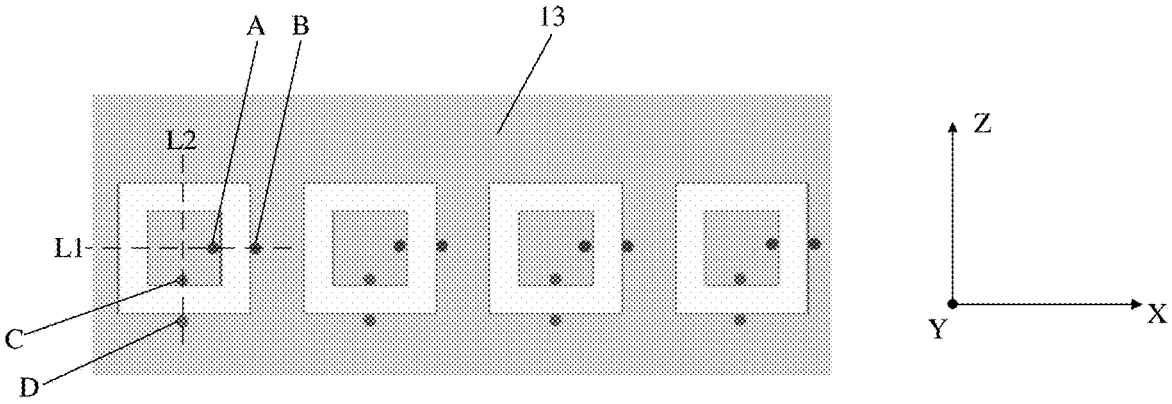
FIG. 3 is a second schematic structural diagram of a side of a metal frame according to some embodiments of the present disclosure.

In some embodiments, reference may be made to FIG. 3 to better understand the foregoing setting way, which is a schematic structural diagram of a side of a metal frame according to some embodiments of the present disclosure. As shown in FIG. 3, at least four slots are provided on the third side 13 of the metal frame 1. Take the leftmost slot as an example, an antenna feed point A, a ground feed point B, an antenna feed point C and a ground feed point D are provided on the metal frame at a side of the slot. The antenna feed point A and the ground feed point B are a group of feed points, the antenna feed point C and the ground feed point D are another group of feed points.

The antenna feed point A and the antenna feed point C are respectively located on a portion of the metal frame corresponding to midpoints of different inner sides of the slot, and the ground feed point B and the ground feed point D are respectively located on another portion of the metal frame corresponding to midpoints of different outer sides of the slot. A straight line L1 determined by the antenna feed point A and the ground feed point B is perpendicular to a straight line L2 determined by the antenna feed point C and the ground feed point D, that is, they are 90 degrees orthogonal. A signal wire of a feed source of a millimeter wave signal is connected to the antenna feed point A and the antenna feed point C, and a ground wire of the feed source is connected to the ground feed point B and the ground feed point D. Each slot is fed with a millimeter wave signal in a same way, and each slot has two feed signals introduced.

Figure 4:
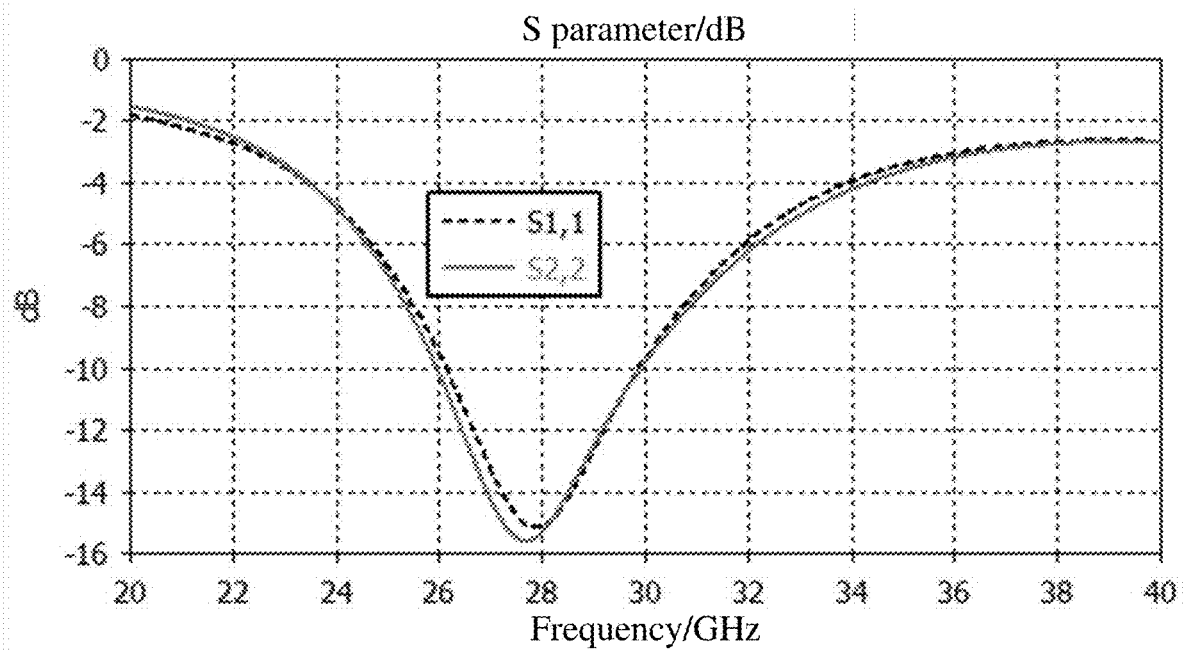
FIG. 4 is a schematic diagram of a return loss of a single slot according to some embodiments of the present disclosure.

Refer to FIG. 4, which is a schematic diagram of a return loss of a single slot according to some embodiments of the present disclosure. Take the leftmost slot in FIG. 3 as an example. In FIG. 4, (S1, 1) is a return loss generated by a feed signal at the antenna feed point A and the ground feed point B, (S2,2) is a return loss generated by a feed signal at the antenna feed point C and the ground feed point D, both of which can cover 26 to 30 GHZ.

In some embodiments, a symmetrical design of an antenna shape allows the terminal device to have a better and more competitive metal appearance. With respect to electrical properties, an orthogonal feeding mode is used for each slot, so that a multiple input and multiple output function can be generated to improve a data transmission rate on one hand, and wireless connection capability of a millimeter wave antenna array can be improved to reduce probability of communications disconnection and improve a communications effect and user experience on the other hand.

Alternatively, the shape of the slot is the rhombus, different groups of feed points in two groups of feed points corresponding to each slot are respectively located on portions of the metal frame corresponding to different corners of the slot.

Figure 5:
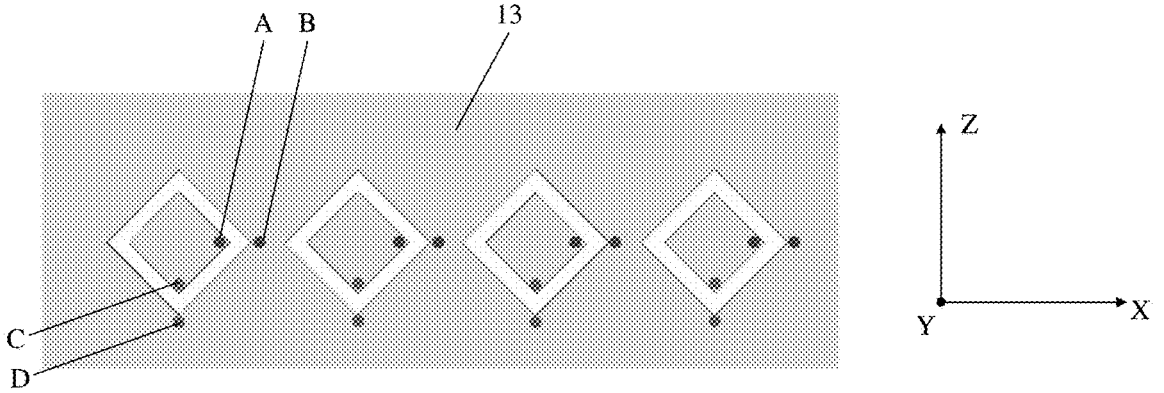
FIG. 5 is a third schematic structural diagram of a side of a metal frame according to some embodiments of the present disclosure.

In some embodiments, reference may be made to FIG. 5 to better understand the foregoing setting way, which is a schematic structural diagram of a side of a metal frame according to some embodiments of the present disclosure. As shown in FIG. 5, at least four slots are provided on the third side 13 of the metal frame 1. Take the leftmost slot as an example, an antenna feed point A, a ground feed point B, an antenna feed point C and a ground feed point D are provided at a side of the slot. The antenna feed point A and the ground feed point B are a group of feed points, the antenna feed point C and the ground feed point D are another group of feed points The antenna feed point A and the antenna feed point C are respectively located on a portion of the metal frame corresponding to different corners of the inner side of the slot, and the ground feed point B and the ground feed point D are respectively located on another portion of the metal frame corresponding to different corners of the outer side of the slot. A straight line determined by the antenna feed point A and the ground feed point B is perpendicular to a straight line determined by the antenna feed point C and the ground feed point D, that is, they are 90 degrees orthogonal. A signal wire of a feed source of a millimeter wave signal is connected to the antenna feed point A and the antenna feed point C, and a ground wire of the feed source is connected to the ground feed point B and the ground feed point D. Each slot is fed with a millimeter wave signal in a same way, and a metal frame corresponding to each slot has two feed signals introduced.

In some embodiments, a symmetrical design of an antenna shape allows the terminal device to have a better and more competitive metal appearance. With respect to electrical properties, an orthogonal feeding mode is used for each slot, so that a multiple input and multiple output function can be generated to improve a data transmission rate on one hand, and wireless connection capability of a millimeter wave antenna array can be improved to reduce probability of communications disconnection and improve a communications effect and user experience on the other hand.

Figure 6:
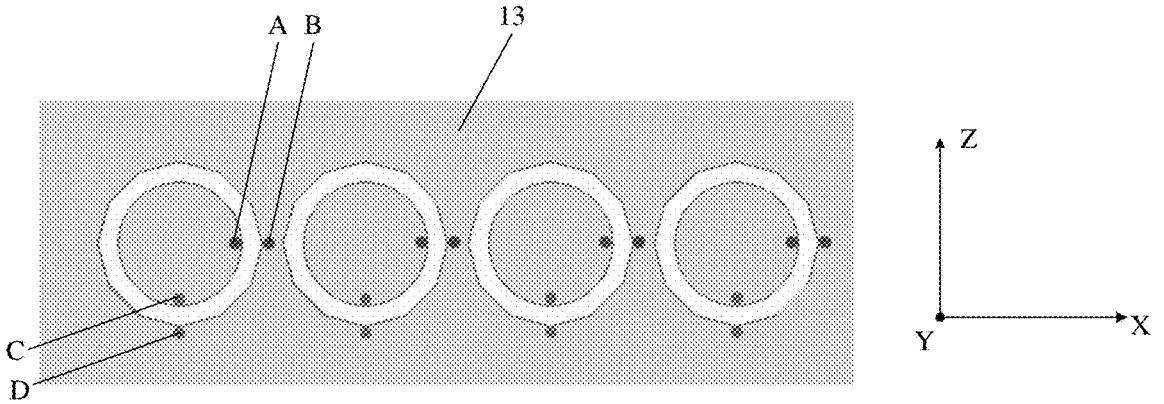
FIG. 6 is a fourth schematic structural diagram of a side of a metal frame according to some embodiments of the present disclosure.

It is sure that the shape of the slot may also be the circle. It is a circle, reference may be made to FIG. 6, which is a schematic structural diagram of a side of a metal frame according to some embodiments of the present disclosure. As shown in FIG. 6, at least four slots are provided on the third side 13 of the metal frame 1. Take the leftmost slot as an example, an antenna feed point A, a ground feed point B, an antenna feed point C and a ground feed point D are provided on the metal frame at a side of the slot. The antenna feed point A and the ground feed point B are a group of feed points, the antenna feed point C and the ground feed point D are another group of feed points.

Both the antenna feed point A and the antenna feed point C are located on a portion of the metal frame at the inner side of the slot, and both the ground feed point B and the ground feed point D are located on another portions of the metal frame at the outer side of the slot. A straight line determined by the antenna feed point A and the ground feed point B is perpendicular to a straight line determined by the antenna feed point C and the ground feed point D, that is, they are 90 degrees orthogonal. A signal wire of a feed source of a millimeter wave signal is connected to the antenna feed point A and the antenna feed point C, and a ground wire of the feed source is connected to the ground feed point B and the ground feed point D. Each slot is fed with a millimeter wave signal in a same way, and each slot has two feed signals introduced. It is sure that as long as the straight line determined by the antenna feed point A and the ground feed point B is perpendicular to the straight line determined by the antenna feed point C and the ground feed point D, this embodiment does not limit a specific position of the antenna feed point and the ground feed point.

In some embodiments, a symmetrical design of an antenna shape allows the terminal device to have a better and more competitive metal appearance. With respect to electrical properties, an orthogonal feeding mode is used for each slot, so that a multiple input and multiple output function can be generated to improve a data transmission rate on one hand, and wireless connection capability of a millimeter wave antenna array can be improved to reduce probability of communications disconnection and improve a communications effect and user experience on the other hand.

Alternatively, each slot of the at least two slots is filled with a non-conductive material.

In some embodiments, each slot of the foregoing at least two slots is filled with a non-conductive material. In this way, the appearance can be more aesthetic, the overall structure strength of the metal frame 1 is better, and the gap is directly exposed outside.

Some embodiments of the present disclosure provide the antenna of the terminal device, the antenna includes a metal frame 1, where a side of the metal frame 1 is provided with at least two slots, and the slots are ring-shaped slots; portions of the metal frame 1 at two sides of each slot of the at least two slots is provided with two groups of feed points, each group of feed points include an antenna feed point located on a portion of the metal frame 1 at the inner side of the slot, and a ground feed point located on another portion of the metal frame 1 at the outer side of the slot; and the metal frame 1 is electrically connected to a floor 2 in the terminal device. In this way, the metal frame 1 provided with the at least two slots is equivalent to a millimeter wave array antenna of the terminal device, and the metal frame 1 is also a radiating body of a non-millimeter wave communications antenna, thus saving space for accommodating a millimeter wave antenna, reducing a volume of the terminal device, and supporting a design of a metal appearance in a better way. In addition, it is compatible with a design of a metal appearance as a solution for another antenna, to improve overall competitiveness of the terminal device.

It should be noted that, in this specification, the terms "include", "comprise", or any variant thereof are intended to cover a non-exclusive inclusion, such that a process, a method, an article, or an apparatus that includes a list of elements not only includes those elements but also includes other elements that are not expressly listed, or further includes elements inherent to such a process, method, article, or apparatus. In the absence of more restrictions, an element defined by the statement "including a . . . " does not preclude the presence of other identical elements in the process, method, article, or apparatus that includes the element.

The embodiments of the present disclosure are described above with reference to the accompanying drawings, but the present disclosure is not limited to the foregoing specific implementations. The foregoing specific implementations are merely schematic instead of restrictive. Under enlightenment of the present disclosure, a person of ordinary skills in the art may make many forms without departing from the protection scope of aims of the present disclosure and claims, all of which fall within the protection of the present disclosure.

What is claimed is:

1. An antenna of a terminal device, the antenna comprising: a metal frame, wherein a side of the metal frame is provided with at least two slots, and the slots are ring-shaped slots;

portions of the metal frame at two sides of each slot of the at least two slots are provided with two groups of feed points, each of the two groups of feed points include an antenna feed point located on a portion of the metal frame at an inner side of the slot, and a ground feed point located on another portion of the metal frame at an outer side of the slot; and the metal frame is electrically connected to a circuit board in the terminal device, so that the metal frame is grounded.

2. The antenna of the terminal device according to claim 1, wherein any group of the two groups of feed points is located on an inner wall of the metal frame.

3. The antenna of the terminal device according to claim 1, wherein the at least two slots are arranged along a length direction of the metal frame.

4. The antenna of the terminal device according to claim 1, wherein spacing between two adjacent slots of the at least two slots is determined by isolation between the two adjacent slots and performance of a beam scanning coverage angle of an array antenna.

5. The antenna of the terminal device according to claim 1, wherein spacing between any two adjacent slots of the at least two slots is the same.

6. The antenna of the terminal device according to claim 1, wherein a shape of the ring-shaped slots is a rhombus, a circle or a regular polygon.

7. The antenna of the terminal device according to claim 6, wherein in the two groups of feed points corresponding to each slot, a straight line determined by a group of feed points is perpendicular or not perpendicular to a straight line determined by another group of feed points.

8. The antenna of the terminal device according to claim 7, wherein each of the ring-shaped slots is a square, and different pairs of feed points in the two groups of feed points corresponding to each slot are respectively located on portions of the metal frame corresponding to midpoints of different sides of the slot.

9. The antenna of the terminal device according to claim 7, wherein each of the ring-shaped slots is a rhombus, and different pairs of feed points in the two groups of feed points corresponding to each slot are respectively located on portions of the metal frame corresponding to different corners of the slot.

10. The antenna of the terminal device according to claim 1, wherein each slot of the at least two slots is filled with a non-conductive material.

* * * * *